US005728007A

United States Patent [19]

Eakin

[11] Patent Number: 5,728,007

[45] Date of Patent: Mar. 17, 1998

[54] GUIDANCE APPARATUS

[76] Inventor: Doyle W. Eakin, 4974 N. Fresno St., #162, Fresno, Calif. 93726

[21] Appl. No.: 634,695

[22] Filed: Apr. 18, 1996

[51] Int. Cl.[6] ..... A63B 69/36

[52] U.S. Cl. ..... 473/244; 473/253

[58] Field of Search ..... 473/251, 252, 473/253, 254, 255, 244

[56] References Cited

U.S. PATENT DOCUMENTS

| | | | |
|---|---|---|---|
| D. 111,855 | 10/1938 | Moreno . | |
| 1,291,967 | 1/1919 | McDougal | 473/251 |
| 1,433,150 | 10/1922 | Reach | 473/251 |
| 1,969,086 | 8/1934 | Luckett . | |
| 4,077,633 | 3/1978 | Studen | 473/251 |
| 4,712,797 | 12/1987 | Kovalchek | 473/251 |
| 4,867,457 | 9/1989 | Lowe . | |
| 5,248,145 | 9/1993 | Brown . | |
| 5,292,128 | 3/1994 | Solheim . | |
| 5,294,122 | 3/1994 | Longo . | |

FOREIGN PATENT DOCUMENTS

| | | |
|---|---|---|
| 328823 | 5/1930 | United Kingdom . |

*Primary Examiner*—George J. Marlo

*Attorney, Agent, or Firm*—Worrel & Worrel

[57] ABSTRACT

A playing club for impelling a projectile over a playing surface toward a target, the playing club comprising a shaft adapted to be gripped by a person using the club; a head mounted on the shaft and having a lower surface adapted to be positioned in contact with the playing surface for movement thereover, an upper surface substantially parallel to the lower surface and including spaced apart reference lines, a front surface defining a substantially flat plane and a back surface, mounted on the head is an indicating assembly having edges convergent upon a point of reference. A locking device is located for adjustably mounting the indicating assembly on the head in overlaying relation to the upper surface thereof with the point of reference adjacent to a place defined by the front surface of the head whereby the axis of reference can be placed in substantial coincidence with target to guide movement of the playing club to move the head into contact with the projectile to impel the projectile over the playing surface toward the target.

9 Claims, 4 Drawing Sheets

GUIDANCE APPARATUS

BACKGROUND OF THE INVENTION

1. Field of the Invention

The present invention relates to a guidance apparatus and, more particularly, to such a guidance apparatus which is uniquely well suited to use as an operable portion of a playing club such as employed in the game of golf or the like.

2. Description of the Prior Art

It is frequently the case in particular operative environments that visual assistance may be helpful or required in achieving objectives associated with the particular operative environment. Depending upon the operative environment involved, such visual assistance may be limited to particular parameters requiring that a certain degree of skill nonetheless be exercised in order to achieve the particular objectives involved.

For example, in recreational activities such as games of skill, it is frequently permissible to use various reference indicators, or other visual assistance, which does not inordinately diminish the level of skill required. Thus, in the game of golf, the rules permit the use of playing clubs and equipment which may be of some assistance in playing the game, but which still require a skill level considered appropriate to the game of golf.

Thus, continuing with the game of golf as the illustrative environment, it has long been known to use golf clubs which have club heads of particular sizes, shapes, weights and bearing markings which may aid the person playing the game in various respects. Such enhancements are deemed to be in compliance with the rules. In this regard, it has been known, particularly in the case of putters, to employ various sighting or aligning mechanisms to aid the golfer in hitting the golf ball at the optimum position thereon and directed along a course which the golfer may believe most closely approximates that required to travel to and enter the hole. Such prior art mechanisms which have previously been employed include various types of marking plates, lines of reference, points of reference and the like.

Notwithstanding such prior art efforts, conventional guidance mechanisms are known to be of very little assistance, can be misused by the players and, in some instances, have actually interfered with the exercise of skill required in playing the game. Furthermore, such prior art devices typically are intended to be of universal application and thus can not be adjusted to suit the preferences or requirements of a particular player. Those few prior art devices that have permitted such adjustment typically do not comply with the rules of golf, are unreliable, or are of such fragile construction that the exigencies of use cause them to become misadjusted or damaged.

Therefore, it has long been known that it would be desirable to have a guidance apparatus which affords visual assistance in a variety of operative environments in such a way as not to detract from a particular operative environment involved; which affords a means by which the visual assistance provided thereby is adjustable to suit the particular preferences of the user in a manner which is entirely dependable and not in conflict with any rules or limitations applicable thereto; which has particular utility in usage on playing clubs such as are employed in the game of golf; which requires little or no training for use; and which otherwise is entirely successful in achieving its operational objectives.

SUMMARY OF THE INVENTION

Therefore, it is an object of the present invention to provide an improved guidance apparatus.

Another object is to provide such a guidance apparatus which is operable to provide visual assistance in a variety of operative environments without detracting from the requirements of those operative environments for the achievement of particular operational objectives.

Another object is to provide such a guidance apparatus which affords visual assistance by providing lines of reference which can readily be understood with little or no instruction in achieving the particular objectives involved.

Another object is to provide such a guidance apparatus which has particular utility in providing visual assistance in movement of a work object in such a fashion as to contact and impel a projectile toward a target such as in games of skill.

Another object is to provide such a guidance apparatus which is successful in overcoming substantially all of the deficiencies experienced in prior art devices adapted for the same broad purposes.

Another object is to provide such a guidance apparats which can readily be adjusted to the particular preferences of a particular user, but which does so without violating the rules and other limitations applying thereto.

Another object is to provide such a guidance apparatus which is uniquely well suited to usage in playing the game of golf by providing lines of reference visually to assist the player in impelling a golf ball along a course of movement most closely corresponding to that which would cause the golf ball to travel to and enter the hole taking into account the surface features between the point of contact and the hole.

Another object is to provide such a guidance apparatus having particular utility in usage on putters employed in the game of golf and adaptable for usage on putters of virtually all types.

Further objects and advantages are to provide improved elements and arrangements thereof in an apparatus for the purpose described which is dependable, economical, durable and fully effective in accomplishing its intended purpose.

These and other objects and advantages are achieved, in the preferred embodiment of the apparatus of the present invention, in a guidance apparatus for assisting in the movement of a work object along a course to impel a projectile toward a target, the guidance apparatus including a mechanism for indicating an axis of reference; and an assembly for mounting the indicating mechanism on the work object in a position at which said axis of reference substantially intersects a point of contact between the work object and the projectile to impel the projectile toward the target.

BRIEF DESCRIPTION OF THE DRAWINGS

FIG. 5-B is a somewhat reduced top plan view of the club head viewed in FIG. 3, but showing the second alternate indicator plate of the present invention.

FIG. 5-C is a somewhat reduced, top plan view of the club head viewed in FIG. 3, but showing the third alternate indicator plate of the present invention.

FIG. 5-D is a somewhat reduced, top plan view of the club head viewed in FIG. 3, but showing the fourth alternate indicator plate of the present invention.

FIG. 5-E is a somewhat reduced, top plan view of the club head viewed in FIG. 3, but fitted with the fifth alternate indicator plate of the present invention.

DESCRIPTION OF THE PREFERRED EMBODIMENTS

Figure 1:
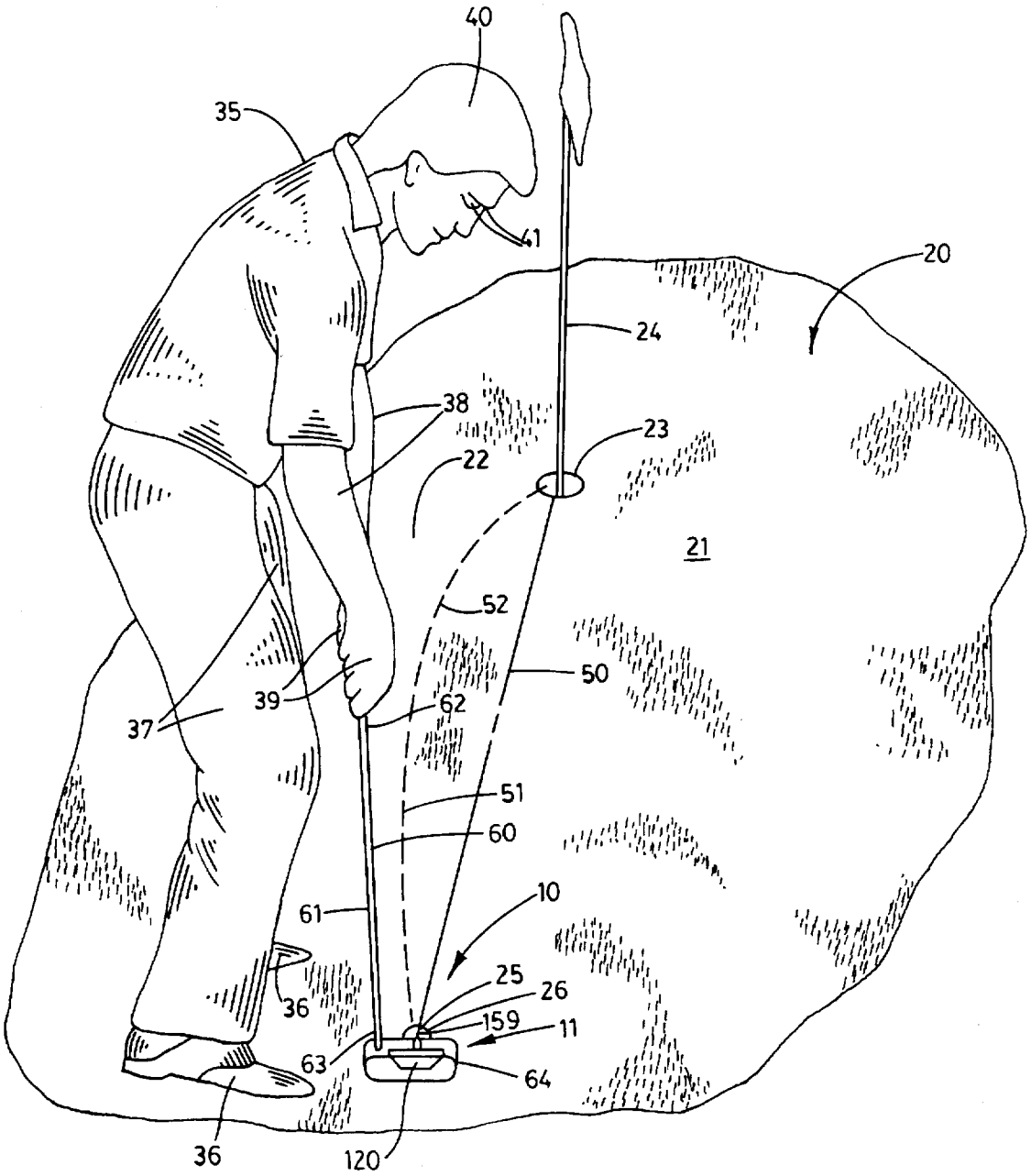
FIG. 1 is a fragmentary perspective view of the apparatus of the preferred embodiment of the present invention shown in a typical operative environment in use during play in the game of golf.

Referring more particularly to the drawings, the guidance apparatus of the present invention is generally indicated by the numeral 10 in FIG. 1. As will subsequently become more clearly apparent, the guidance apparatus of the present invention can be viewed as having a guidance assembly generally indicated by the numeral 11 in FIG. 1.

As shown in FIG. 1, the guidance apparatus is depicted in a typical operative environment, that being in use in playing the game of golf. Thus, as shown therein, a green or playing area is generally indicated by the numeral 20 having a playing surface 21 typically formed by very low growing, compact and substantially planar lawn or grass. The playing surface typically has an uneven contoured surface which may be difficult visually to perceive. Thus, for illustrative convenience, it will be understood that the playing surface is contoured in such a manner as to present a variety of depressions, raised areas and slopes of various grades. In addition, there are areas along which a golf ball will roll comparatively quickly or slowly, depending upon such surface as moisture, sand, or other debris, and areas in which the lawn is relatively more thick or, conversely, sparse, and the like. Thus, for illustrative convenience, it will be understood that the playing surface has a raised contour generally indicated at 22. A target or hole is indicated by the numeral 23 in which, in the conventional manner, a marker or flag 24 is removable received. A projectile or golf ball is indicated at 25 having a generally spherical outer surface.

A player is indicated at 35 in an attitude appropriate for use of the guidance apparatus. The player's feet are indicated at 36, legs at 37, and arms at 38. The player's hands are indicated at 39 with the player's head and eyes indicated at 40 and 41, respectively. For illustrative convenience and as will subsequently be discussed in greater detail, in FIG. 1 a first trajectory is indicated at 50, and a second trajectory at 51. The apex or high point of the second trajectory is generally indicated at 52.

Figure 3:
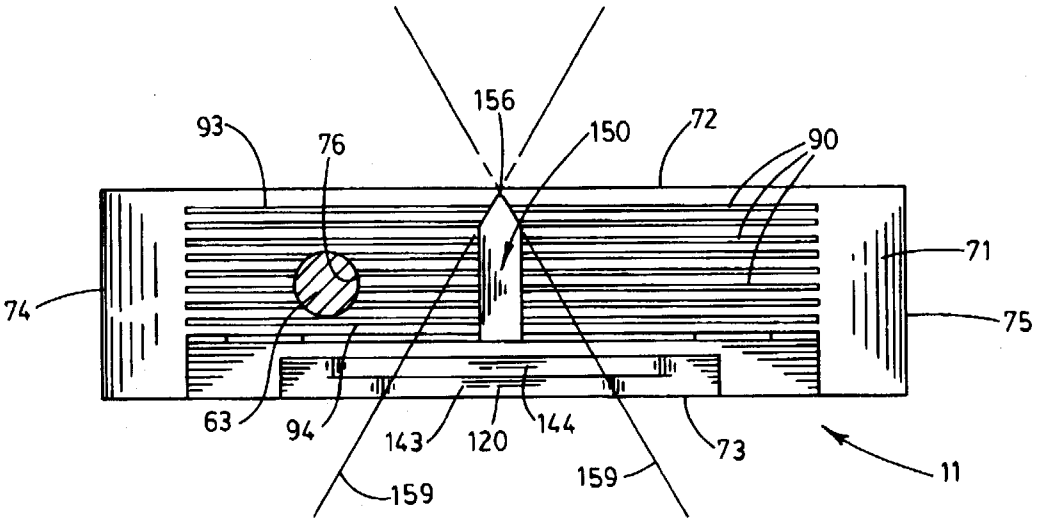
FIG. 3 is a top plan view of the head of the playing club mounting the guidance apparatus of the present invention showing the shaft of the playing club sectioned along a plane right-angularly related to the longitudinal axis of the shaft.
Figure 4:
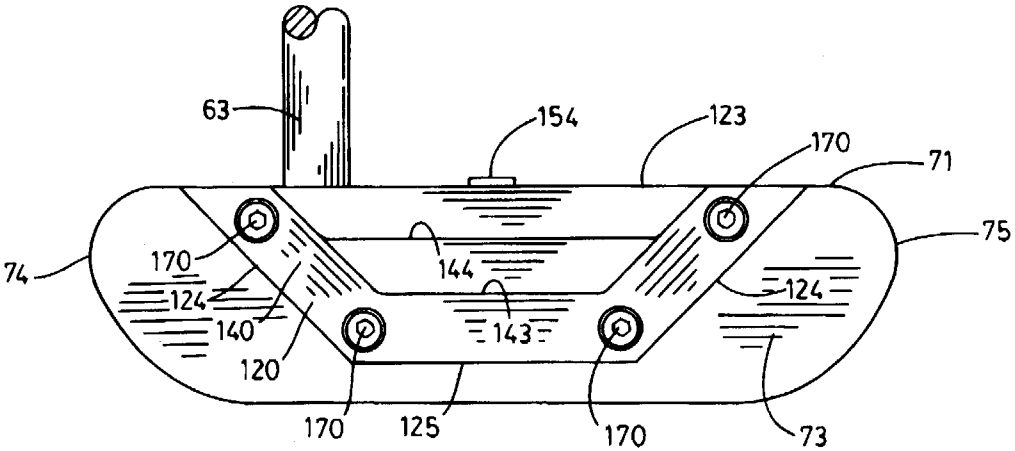
FIG. 4 is a rear elevation of the head of the playing club mounting the guidance apparatus of the present invention and showing the shaft of the playing club section along a plane right-angularly related to the longitudinal axis of the shaft.
Figure 5A:
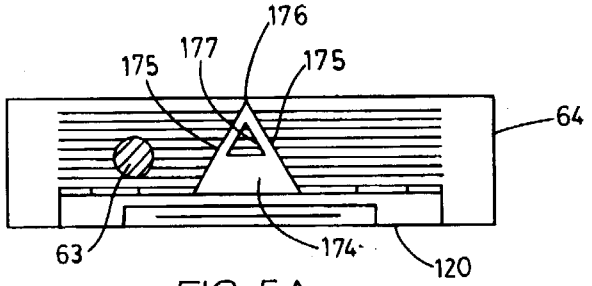
FIG. 5-A is a somewhat reduced top plan view of the club head viewed in FIG. 3, but fitted with a first alternate indicator plate of the present invention.
Figure 5B:
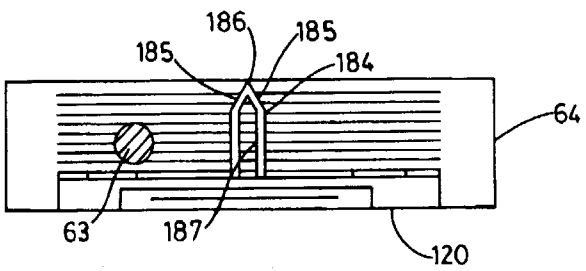
Figure 5C:
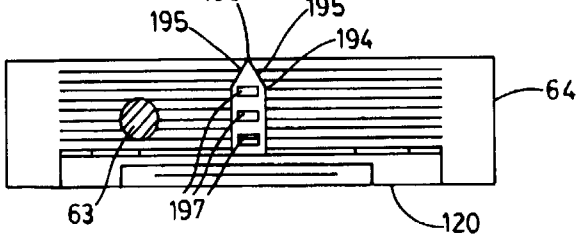
Figure 5D:
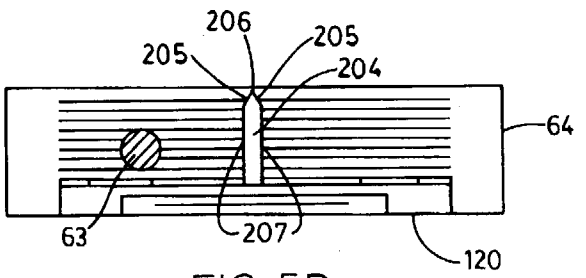
Figure 5E:
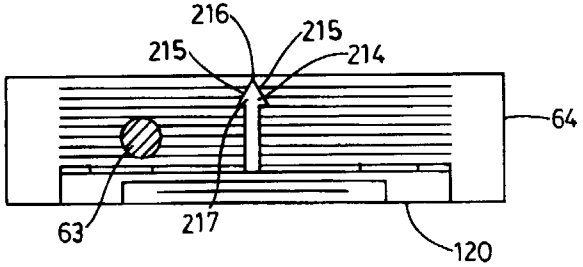

In the illustrative embodiment of the present invention, a work instrument or golf club 60 has a metal shaft 61 extending from a grip or upper end portion 62 to an opposite lower end portion 63. A club head 64 is mounted on the lower end portion 63. The club head has a sole or lower surface 70 defining a flat plane and an opposite upper surface 71 generally defining a flat plane parallel to the lower surface. The club head has a face 72 which is right angularly related to the lower and upper surfaces 70 and 71 and an opposite trailing surface 73 which is generally substantially parallel to the face 72. As shown in FIGS. 3 and 4, the club head has a proximal shoulder 74 and an opposite distal shoulder 75. The shoulders are of rounded configurations interconnecting the lower and upper surfaces of the club head. A bore 76 extends inwardly of the club head through the upper surface 71 defining a longitudinal axis right angularly related to the upper surface.

A plurality of reference lines or grooves 90 are formed in the upper surface 71 of the club head 64 extending in equally spaced, parallel relation to each other and to the face 72 and trailing surface 73 of the club head. The grooves extend from proximal ends 91 adjacent to the proximal shoulder 74 to distal ends 92 adjacent to the distal shoulder 75. With respect to the normal path of movement of the club head, the grooves include a leading reference line or groove 93 and a trailing reference or groove line 94.

Figure 2:
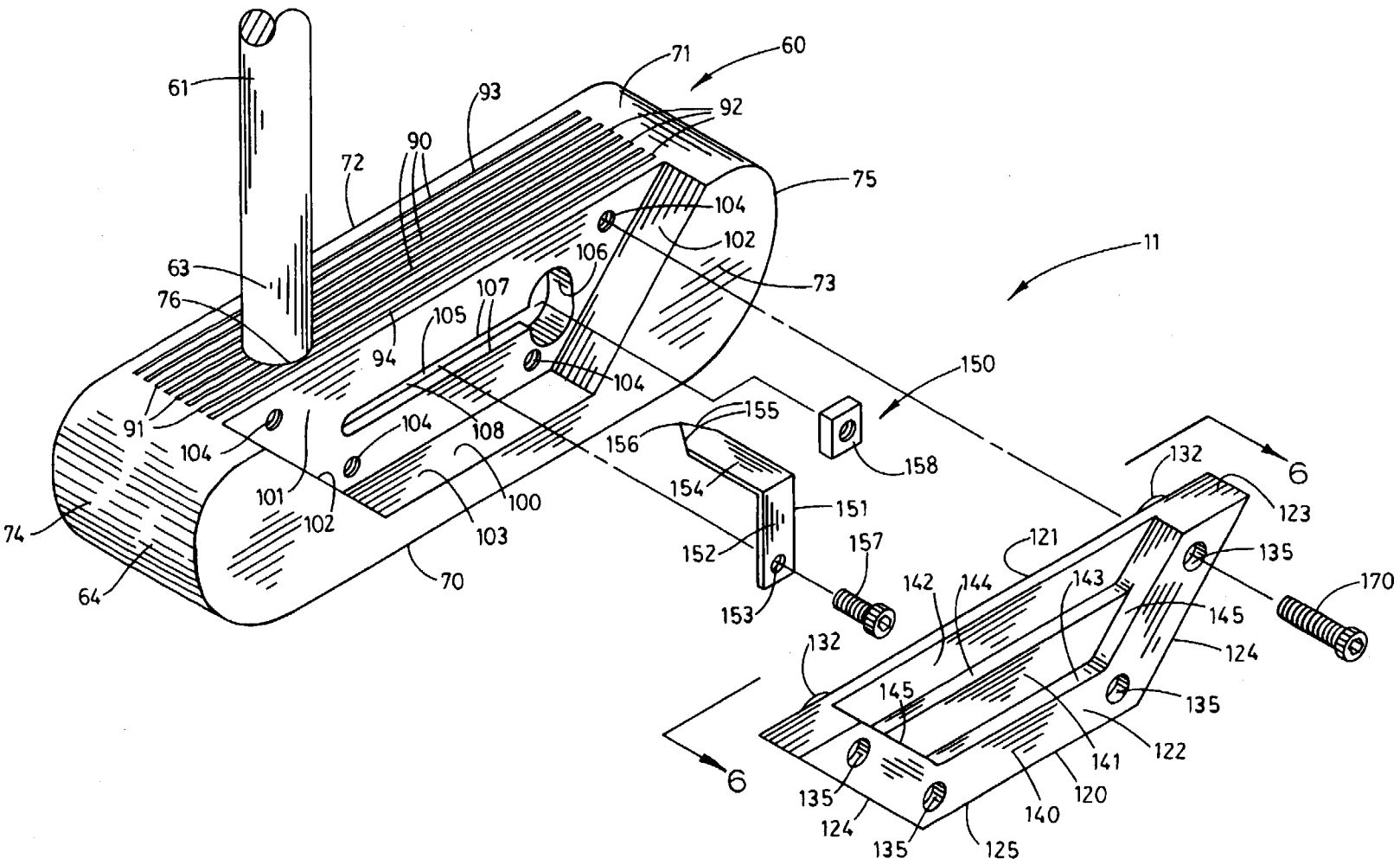
FIG. 2 is a somewhat enlarged, fragmentary, exploded perspective view of the apparatus of the present invention showing the internal operative components thereof.

A receptacle 100 is formed in the club head 64, as best shown in FIG. 2. The receptacle is defined by an interior vertical face 101 extending in right angular relation to the upper surface 71 of the club head. The receptacle is bounded on opposite sides by downwardly convergent, sloped surfaces 102. The receptacle is bounded at the lowermost portion thereof by a lower surface 103 which is right angularly related to the interior vertical face 101 and thus parallel to the lower surface and upper surface 70 and 71, respectively, of the club head. Four internally screw threaded holes 104 extend into the club head through the vertical face 101 in predetermined positions, as best shown in FIG. 2. The screw threaded holes individually define longitudinal axes which are right angularly related to the interior vertical face. A slot 105 extends into the interior vertical face 101 defining a longitudinal axis parallel to the plane defined by the upper surface 71 of the club head. The slot has a predetermined length and transverse dimension. The slot communicates on the right, as viewed in FIG. 2, with an entrance opening 106 of a substantially oval configuration and having both a transverse and a longitudinal dimension substantially greater than that of the transverse dimension of the slot. The slot is bounded by flanges or lips 107 and communicates with a channel 108 internally of the club head. The channel has a transverse dimension substantially equal to the longitudinal dimension of the entrance opening 106 and thus greater than the transverse dimension of the slot 105. The channel extends from the entrance opening 106 the full length of the slot 105 and preferably to a point just beyond the slot to the left thereof, as viewed in FIG. 2.

A locking or back plate 120 is adapted to be mounted in the receptacle 100 of the club head 64 so as to form an integral part thereof, as best shown in FIGS. 3 and 4. The back plate has an interior surface 121 and an opposite exterior surface 122. The back plate has an upper surface 123 and opposite sloped surfaces 124. The back plate has a lower surface 125 which is parallel to the upper surface 123. The back plate is dimensioned to be received within the receptacle in fitted relation, as may best be visualized in FIGS. 3 and 4.

Figure 6:
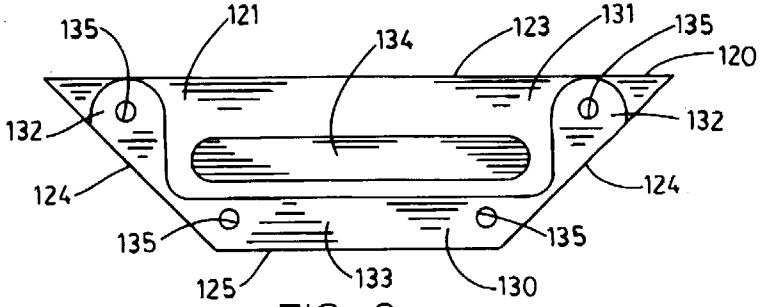
FIG. 6 is a somewhat enlarged elevation of the locking plate of the guidance apparatus of the present invention showing the interior surface thereof.

Referring more particularly to FIG. 6, the back plate 120 has an extended surface 130 defining a substantially flat plane and a recessed surface 131 defining a flat plane parallel to the plane defined by the extended surface. The extended surface is thus provided with a pair of spaced shoulders 132 and a base 133 interconnecting the shoulders, and with the shoulders, forming the extended surface 130. A longitudinal slot 134 is formed in the recessed surface 131 extending along a longitudinal axis between the shoulders and along a course parallel to the base 133. A pair of smooth screw holes 135 individually extend through the shoulders 132 and through the base 133 at opposite ends thereof. The screw holes 135 define a pattern matching that of the screw threaded holes 104, as may best be visualized in FIG. 2.

The exterior surface 122 of the back plate 120 has an extended surface 140 defining a flat plane parallel to the planes defined by the extended and recessed surfaces 130 and 131, respectively, of the interior surface 121 of the back plate. The exterior surface 122 includes a first recessed surface 141 spaced inwardly of the extended surface 140 a predetermined distance and defining a plane parallel thereto. A second recessed surface 142 is provided in the exterior surface spaced inwardly from the extended surface 140 and the recessed surface 141 predetermined distances and defining a plane parallel thereto. The extended surface 140 and first recessed surface 141 are interconnected by a first stepped surface 143 defining a plane right angularly related thereto. A second stepped surface 144 interconnects the first recessed surface 141 and the second recessed surface 142 defining a plane right angularly related thereto. The first recessed surface, second recessed surface, first stepped surface and second stepped surface are bounded at opposite ends by sloped surfaces 145 individually defining planes parallel to the sloped surfaces 124 at the opposite ends of the back plate 120.

The guidance apparatus 10 has an indicator assembly generally indicated by the numeral 150 in FIG. 2. The indicator assembly has an indicator plate 151 preferably constructed of metal and having a mounting portion 152 defining a flat plane with a hole 153 extending therethrough in a predetermined position. The indicator plate has a directional portion or plate 154 right-angularly related to the mounting portion 152 and preferably constructed so as to be integral therewith. The directional plate terminates in convergent edges and extending to a point of reference or apex 156. A screw 157 is dimensioned to be extended through the hole 153 and screw threadably to mount a nut 158 of predetermined dimensions thereon. The indicator assembly 150 is mounted on the club head 164 by the screw 157 extending through the hole 153 of the indicator plate and the nut 158 being screw-threadably secured on the terminal end of the screw on the opposite side of the indicator plate 151. The nut is then passed into the entrance opening 106 and moved to the left, as viewed in FIG. 2, so that the nut passes into the channel 108 and is captured in position by the transverse dimensions of the channel and the lips 107 bounding the slot. The nut 158 is so dimensioned as to thus be slidable to any position within the channel along the slot but, being of a square configuration, is prevented by the transverse dimension of the channel from turning. Thus, the indicator plate can be moved to any selected position, the screw 157 tightened down within the nut until the indicator plate is captured between the head of the screw and the lips 107 as secured in position by the nut 158. Once tightened into the selected position, the indicator plate cannot be moved therefrom without screw-threadably loosening the screw 157 from the nut 158. When secured in this selected position, the directional plate 154 of the indicator plate 151 is disposed in the position shown in FIGS. 3 and 4 with the point of reference 156 in immediate juxtaposition to the face 72 of the club head. As shown in FIG. 3, the convergent edges 155 of the directional plate individually define reference axes 159 which can be employed, as will hereinafter be described in greater detail.

When the indicator assembly 150 is secured in the selected position, as heretofore described, the back plate 120 is removably mounted in the receptacle 100 of the club head 64 in the position shown in FIGS. 3 and 4. This is achieved by placing the extended surface 130 of the interior surface 121 of the back plate in facing engagement with the interior vertical face 101 of the club head and with the remainder of the back plate in the fitted relationship shown in FIGS. 3 and 4. Screws 170 are thereafter individually extended through the smooth screw holes 135 of the back plate and screw-threadably secured in the internally screw threaded holes 104 of the club head until the back plate is securely retained in the position shown in FIGS. 3 and 4. It will be seen that when the back plate is in this installed position, the indicator assembly 150 is captured in the selected position heretofore described and cannot be removed or dislodged therefrom without removal of the back plate. In this installed position, the head of the screw 157 is received in the slot 134 of the back plate so that there is no interference between the back plate and the indicator assembly in the installed position.

Referring more particularly to FIGS. 5-A through 5-E, a plurality of alternate configurations for the indicator plate are individually shown therein. As shown in FIG. 5-A, a first alternate indicator plate is indicated by the numeral 174. Other than the form of the indicator plate itself, the indicator assembly is identical to that heretofore described. The indicator plate 174 has convergent edges 175 converge at a point of reference or apex 176 and having a triangular opening 177 extending therethrough through which, in the installed position, the referenced lines 90 therebeneath can be seen.

In FIG. 5-B, a second alternate indicator plate is indicated by the numeral 184. Except as is visible in FIG. 5-B, the structure of the indicator assembly shown therein is identical otherwise to that heretofore described. The indicator plate 185 has convergent edges 185 extending to a point of reference or apex 186. The indicator plate has an elongated opening 187 through which the reference lines 90 can be viewed.

A third alternate indicator plate is indicated by the numeral 194 in FIG. 5-C. Except as visible in FIG. 5-C, the structure of the indicator assembly connected thereto is identical to that heretofore described. The indicator plate 194 has convergent edges 195 leading to a point of reference or apex 196. A plurality of openings 197 extend through the indicator plate individually communicating with three of the reference lines 90.

As shown in FIG. 5-D, a fourth alternate indicator plate is indicated by the numeral 204. Except as is visible in FIG. 5-D, the structure of the indicator assembly connected thereto is identical to that heretofore described. The indicator plate 204 as convergent edges 205 extending to a point of reference or apex 206. The indicator plate has parallel lateral edges 207.

Finally, as shown in FIG. 5-E, a fifth alternate indicator plate is indicated by the numeral 214. Except as is visible in FIG. 5-E, the structure of the indicator assembly connected thereto is identical to that heretofore described. The indicator plate 214 has convergent edges 215 leading to a point of reference or apex 216. The shape of the indicator plate is that of an arrowhead 217.

Operation

The operation of the described embodiment of the subject invention is believe to be clearly apparent and is briefly summarized at this point.

Mounting and adjustment of the indicator assembly 150 on the club head 64 has already been described and need not be repeated. It is sufficient to note that the directional plate 154 thereof can be adjusted laterally, either left or right, from the position shown in FIG. 3, for example, along the reference lines 90, thus moving the point of reference 156 to any desired position therealong. This is accomplished by removal of the back plate 120 as heretofore described, loosening the screw 157 in the nut 158 and thereafter sliding the indicator plate and the attached screw and nut laterally within the slot 105 to the desired position. As previously noted, once the desired position has been selected, the screw 157 is again tightened in the nut 158 securely to capture the indicator plate in the selected position. When the back plate 120 is again secured in position, as shown in FIGS. 3 and 4, using the screws 170, the indicator assembly cannot be repositioned. Thus, in accordance with the rules of the game of golf, the indicator assembly 150 cannot be readjusted during game play, as a practical matter. This permits a player to select a desired location for the indicator assembly prior to game play, but not to readjust the position during game play, thereby being in full compliance with the rules of play.

As illustrated in FIG. 1, the player 35 is in a typical attitude for use of the golf club 60 mounting the indicator assembly 150 secured in the selected position. As depicted therein, the player, of course, is attempting to strike the golf ball 25 with the face 72 of the club head 64 at such an attitude and velocity as to cause the golf ball to travel across the playing surface 21 along a course and at a velocity which will carry it toward and preferably into the hole 23. In the illustrative example, since the playing surface has a raised contour 22, the player may conclude, for example, that the course selected for travel of the golf ball may most effectively be either the first trajectory 50 or the second trajectory 51. In making this determination, of course, the player takes into account the raised contour 22 of the playing surface as well as other surface variations and conditions previously enumerated.

The player 35, having experience using the guidance apparatus 10 of the present invention, will normally have positioned the point of reference 156 in a selected position immediately above the point on the face 72 of the playing club 64 at which it is preferred that contact be made with the golf ball. If the selected trajectory is the first trajectory 50, which constitutes a substantially direct path to the hole 23, the player may wish to make contact with the golf ball at the point on the face immediately below the point of reference 156 and with the lines of reference 90 disposed in right angular relation to the trajectory 50. The player then simply moves the club head 64 along a path achieving this orientation and with a sufficient velocity to attempt to achieve this result. Thus, while the guidance apparatus 10 of the invention assists in providing visual references to aid in the achievement of the objective, consistent with the rules of the game of golf, the player must execute this maneuver with sufficient skill to achieve the result.

Conversely, for illustrative convenience, if the player 35 determines, after evaluation of the playing surface 21 and the raised contour 22, that the most effective trajectory would be the second trajectory 51, the player may orient the club head 64 so that contact is made with the face 72 of the playing club beneath the point of reference 156, but the club head is oriented so that the reference lines 90 are disposed in right angular relation to the second trajectory, as visualized by the player. In so orienting the club head, the player is provided with assistance in visualizing reference axes 159 defined by the convergent edges 155 of the directional plate 154. These reference axes thus, in effect, define a zone extending from the point of reference 156 in the general direction of the hole 23. This zone permits the player to orient the face 72 of the club head so that, for example, the reference axis 159 extending from the face to the right, as viewed in FIG. 3, is aligned with the flag 24 thereby orienting the face so as to make contact with the ball to drive it to the left, as viewed in FIG. 1, along the second trajectory 51. The player may also visualize a multiplicity of other reference axes 159 within the zone bounded by the reference axes 159 assisting in providing visual reference points for positioning and movement of the club head for the purposes described. In this regard, experience with use of the guidance apparatus will generally permit an improvement in the level of skill exercised.

The first alternate indicator plate 174, second alternate indicator plate 184, third alternate indicator plate 194, fourth alternate indicator plate 204 and fifth alternate indicator plate 214, shown in FIGS. 5-A through 5-E respectively, also provide the reference characteristics described in relation to the preferred embodiment of the present invention. The particular indicator plate employed may be dependent upon the preferences of the player 35 which may change from time to time. Where this occurs, the alternate indicator plates can be substituted for each other and for that of the preferred embodiment through the process heretofore described of removing the back plate 120 and installing the desired indicator plate. Alternate indicator plates 174, 184 and 194 provide the additional feature in that the lines of reference 90 can be viewed through the indicator plate. The indicator plates 204 and 214 conversely more closely approximate purely directional indicators.

Therefore, the guidance apparatus of the present invention affords visual assistance in a variety of operative environments in such a way as not to detract from the particular operative environments involved; affords a means by which the visual assistance provided thereby is adjustable to suit the particular preferences of the user in a manner which is entirely dependable and not in conflict with any rules or limitations applicable thereto; has particular utility in use on playing clubs such as are employed in the game of golf; requires little or no training for use; and is otherwise entirely successful in achieving its operational objectives.

Although the invention has been herein shown and described in what is conceived to be the most practical and preferred embodiment, it is recognized that departures may be made therefrom within the scope of the invention which is not to be limited to the illustrative details disclosed.

Having described my invention, what I claim as new and desire to secure by Letters Patent is:

1. A playing club for impelling a projectile over a playing surface toward a target, the playing club comprising a shaft adapted to be gripped by a person using said playing club; a head mounted on the shaft having a lower surface adapted to be positioned in contact with the playing surface for movement thereover, an upper surface substantially parallel to the lower surface, a front surface defining a substantially flat plane and a back surface; an indicating assembly having edges convergent upon a point of reference; means substantially internally of said head for adjustably mounting said indicating assembly on the head in overlaying relation to the upper surface thereof with said point of reference adjacent to a plane defined by said front surface of the head, said indicating assembly being a plate having a substantially right-angularly related mounting portion and the mounting means including a track mounted internally of the head beneath the upper surface thereof and substantially parallel thereto and a fastener releasably interconnecting said mounting portion remote from said point of reference to mount the plate adjacent to the point of reference in overlaying relation to the upper surface of the head whereby the fastener can be released to move the plate to a selected position overlaying said upper surface and then be secured releasably to retain the indicating assembly in said selected position, whereby said axis of reference can be placed in substantial coincidence with the target to guide movement of the playing club to move the head into contact with the projectile to impel the projectile over the playing surface toward the target.

2. The playing club of claim 1 wherein the upper surface of the head has a plurality of substantially parallel reference lines extending thereacross disposed in substantially right angular relation to said axis of reference and overlayed by said indicating assembly to provide visual assistance in moving the playing club.

3. The playing club of claim 2 wherein said reference lines on the upper surface of the head are formed by grooves of a predetermined width and spacing and including means for spacing the plate from the upper surface of the head in said installed position to define a space substantially of said predetermined width and spacing to simulate one of said reference lines.

4. The playing club of claim 3 wherein the said portion of the indicating assembly remote from the point of reference extends through said space between the plate and the upper surface of the head.

5. The playing club of claim 1 wherein said track is a slot internally of the head communicating with a passage of larger transverse dimension than the slot and the fastener is a nut and screw assembly wherein the nut is dimensioned for slidable receipt in the passage captured therein and the screw is dimensioned to extend through the slot whereby loosening of the screw in the nut permits the nut and screw assembly and the plate to be moved along the track.

6. The playing club of claim 5 wherein the head has a receptacle extending toward the lower surface of the head from the upper surface thereof and inwardly from the back surface of the head to the slot and including a cover plate dimensioned to be mounted in an installed position in the receptacle in covering relation to the slot and the mounting portion of the indicating assembly remote from the point of reference so as to capture the indicating assembly with the point of reference in the selected position.

7. The playing club of claim 6 wherein the playing club is adapted for the purpose of playing the game of golf and said cover plate is mounted in the receptacle with bolts which must be removed to permit removal of the cover plate for the purpose of loosening the nut and screw assembly to move the indicating assembly to another selected position.

8. The playing club of claim 7 wherein the cover plate has an interior surface having a slot therein adapted to receive the head of the screw of said nut and screw assembly in said installed position.

9. The playing club of claim 8 wherein the cover plate has an exterior surface having stepped portions defining edges visually substantially parallel to the reference lines along a line of sight right-angularly related to the upper surface of said head.

* * * * *

UNITED STATES PATENT AND TRADEMARK OFFICE

CERTIFICATE OF CORRECTION

PATENT NO. : 5,728,007

DATED : March 17, 1998

INVENTOR(S) : Doyle W. Eakin

It is certified that error appears in the above-identified patent and that said Letters Patent is hereby corrected as shown below:

Column 2, Line 23, delete "apparats" and substitute

---apparatus---.

Signed and Sealed this

Twenty-sixth Day of May, 1998

Bruce Lehman

*Attest:*

BRUCE LEHMAN

*Attesting Officer*

*Commissioner of Patents and Trademarks*